United States Patent [19]

Bock et al.

[11] Patent Number: 4,730,814

[45] Date of Patent: Mar. 15, 1988

[54] BLAST PIPE FOR REFINING NOZZLE

[75] Inventors: André Bock, Luxembourg; Roamin Henrion; Jean Liesch, both of Esch; Carlo Heintz, Luxembourg; Henri Klein, Niedercorn; Jean-François Liesch, Esch, all of Luxembourg

[73] Assignee: Arbed S.A., Luxembourg, Luxembourg

[21] Appl. No.: 17,883

[22] Filed: Feb. 20, 1987

[30] Foreign Application Priority Data

Feb. 28, 1986 [LU] Luxembourg ..... 86329

[51] Int. Cl.[4] ..... C21C 5/32

[52] U.S. Cl. ..... 266/266; 266/225

[58] Field of Search ..... 266/218, 225, 265, 266, 266/267

[56] References Cited

U.S. PATENT DOCUMENTS

| | | | |
|---|---|---|---|
| 3,015,481 | 1/1962 | Clingensmith | 266/266 |
| 3,627,294 | 12/1971 | Hill | 266/225 |
| 4,366,953 | 1/1983 | Colling et al. | 266/266 |
| 4,434,005 | 2/1984 | Metz et al. | 266/225 |

FOREIGN PATENT DOCUMENTS

| | | | |
|---|---|---|---|
| 1064970 | 9/1959 | Fed. Rep. of Germany | 266/225 |
| 3231867 | 3/1984 | Fed. Rep. of Germany | 266/225 |

*Primary Examiner*—L. Dewayne Rutledge
*Assistant Examiner*—Robert L. McDowell
*Attorney, Agent, or Firm*—Fishman & Dionne

[57] ABSTRACT

A blast pipe for delivering refining oxygen to the space above a metal bath in a refining operation is presented. The blast pipe is positioned in a gas supply duct and is provided with a pressure regulating valve. The blast pipe comprises a fixed straight wall portion along which the gas flows in a linear path. The straight wall portion terminates at a sharp edge, constituting a portion of the blast pipe exit orifice. A bent wall segment is located adjacent to and downstream of the straight wall portion and connects the remainder of the straight wall portion to the exit orifice. The bent wall segment preferably has a convergent configuration, upstream of the sharp edge, and a divergent configuration downstream thereof. The exit orifice, in cross section, has the shape of a rectangle, one of the long sides of which constitutes the sharp edge.

13 Claims, 2 Drawing Figures

BLAST PIPE FOR REFINING NOZZLE

BACKGROUND OF THE INVENTION

This invention relates to a blast pipe for a refining nozzle. More particularly, this invention relates to a blast pipe for supplying after combustion oxygen to the space above a metal bath in a refining operation.

Refining nozzles are known which, not only include the blast pipes for delivering the supersonic primary oxygen for refining, but also possess numerous auxiliary pipes. Such auxiliary pipes are inclined between 25° and 60° with respect to the vertical axis (see for example Luxembourg Patent LU Nos. 78 906 and 83 814 corresponding to U.S. Pat. No. 4,434,005 which is assigned to the assignee hereof and incorporated herein by reference) and emit jets of oxygen for providing after combustion. Because these oxygen jets are subsonic, the auxiliary blast pipes are supplied by an independent oxygen circuit which permits regulation of the flow. It is also well known (see LU No. 82 846 corresponding to U.S. Pat. No. 4,366,953, assigned to the assignee hereof, all of the contents of which are incorporated herein by reference) to equip the ducts of the auxiliary pipes carrying after combustion oxygen with means to increase the degree of turbulence of the primary jet. This turbulence increasing means may consist of plates arranged within the ducts of the secondary blast pipes so as to form spirals. In other embodiments, the turbulent means comprise the walls of the ducts being provided with grooves which can be (1) circular, (2) arranged in a plane perpendicular to the axis of the duct or (3) spiralled.

In the prior art, the angles of inclination of the auxilliary blast pipes directing after combustion oxygen jets, after being determined by tests or empirical methods (taking into account the inclinations of primary oxygen jets, their arrangement, the dimensions of the converter, the height of the nozzle head above the bath, etc.), will remain constant. Thus, it is not possible to sweep the space above the bath with oxygen jets; nor it is possible to deliver after combustion oxygen into the converter at an angle dependent upon the refining phase in progress. Of course, this problem could be solved by equipping blast pipes with some sort of mechanical system enabling their angle of inclination to be modified. Unfortunately, such a system would be directly exposed to the difficult conditions existing within a converter (temperatures varying between 800° and 1800° C., projections of slag, of liquid metal, etc.), so as to have only a very short life. Moreover, variations of inclination obtained by mechanical means would be too slow to create an extended zone which would be virtually always supplied with oxygen.

Another disadvantage of known blast pipes is that the oxygen is delivered into the space above the bath in discrete jets. As a result, the concentration of oxygen, with respect to that of carbon monoxide, is on the one hand excessively high within the jet, and on the other hand, too low in the space between two jets. The volume above the bath in which the presence of oxygen and carbon monoxide can be ensured in essentially stoichiometric quantities to initiate and sustain combustion is thus limited.

SUMMARY OF THE INVENTION

The above-described and other problems and deficiencies of the prior art are overcome or alleviated by the blast pipe of the present invention. In accordance with the present invention a blast pipe is provided which avoids the disadvantages of the prior art described above; and which enables delivery of an oxygen jet into a converter with variable inclinations and without employing a delicate mechanical system.

The blast pipe of the present invention for delivering after combustion oxygen to the space above a metal bath in a refining operation is located in a gas supply duct and is provided with a pressure regulating valve. The blast pipe comprises a fixed straight wall portion along which the gas flows in a linear path. The straight wall portion terminates at a sharp edge constituting a portion of the blast pipe exit orifice. A bent wall segment is located adjacent to and downstream of the straight wall portion and connects the remainder of the straight wall portion to the exit orifice. The bent wall segment preferably has a convergent configuration, upstream of the sharp edge, and a divergent configuration downstream thereof. The exit orifice, in cross section, has the shape of a rectangle, one of the long sides of which constitutes the sharp edge.

The above-described and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 2:
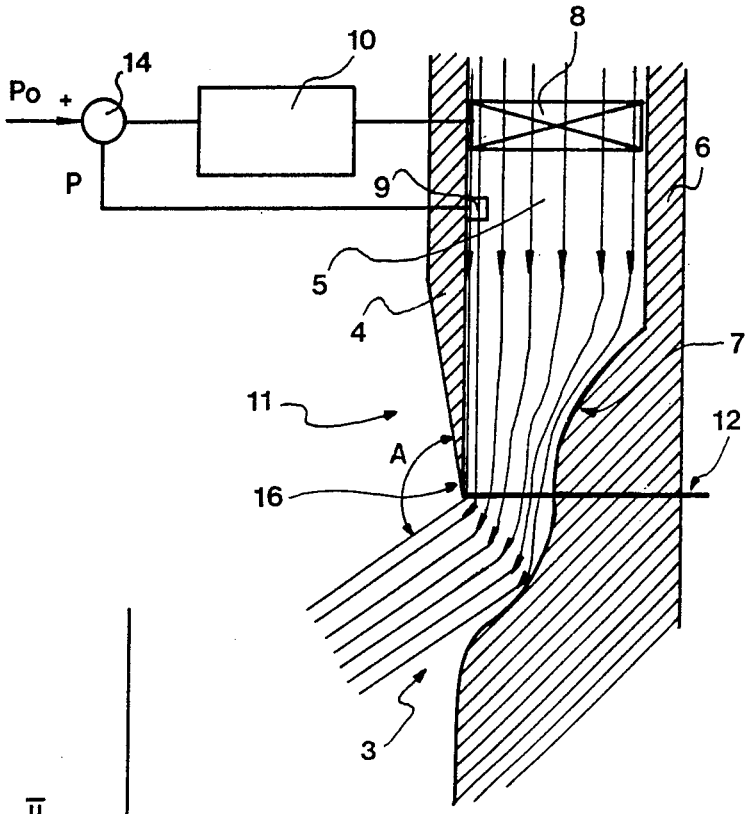
FIG. 2 is a cross sectional elevational view along the line II—II of FIG. 1.
Figure 1:
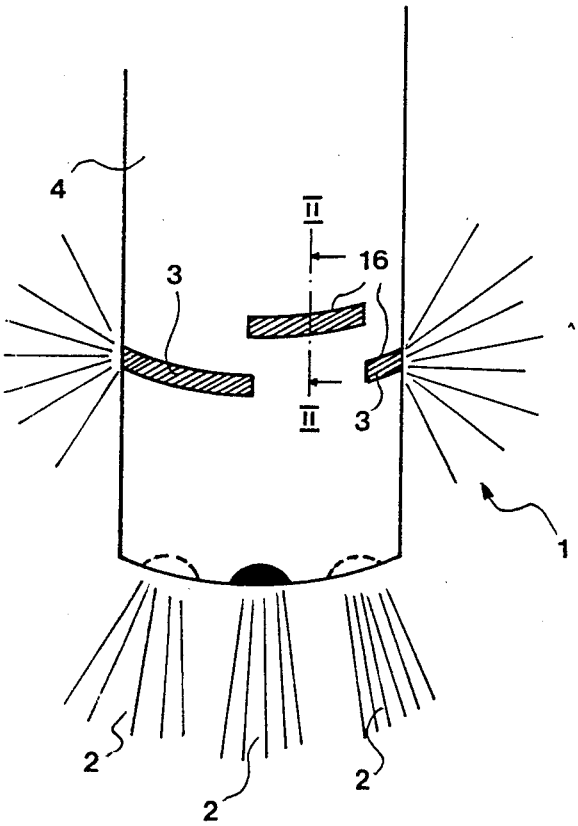
FIG. 1 is a schematic side view of a refining nozzle equipped with blast pipes in accordance with the present invention.

In FIG. 1, a nozzle body is shown generally at 1 with three jets 2 of refining oxygen exiting from the nozzle head. Recessed from the nozzle head, at a distance of about 1 meter, are orifices 3 from a plurality of blast pipes arranged at different heights along the periphery of the nozzle body. These orifices 3 supply after combustion oxygen. In the cross sectional FIG. 2, a gas supply duct 5 is shown opening into a blast pipe 11. An outer jacket 4 of nozzle 1 defines one side of both duct 5 and blast pipe 11, as a straight surface along which oxygen flows in a linear path up to a straight-line edge 16 forming a portion of orifice 3. The remainder of the wall of duct 5, designated as 6, is connected to the remaining portion of orifice 3 by a bent wall segment 7, which defines a convergent blast pipe. A throat upstream of edge 16 is thus defined by bent wall segment 7.

A valve 8 controls the oxygen flow. Valve 8, which for reasons of convenience has been drawn close to orifice 3, is normally located near the supports (not shown) of nozzle body 1 (a distance of about ten meters). A distance of about ten meters from valve 8 to orifice 3 also tempers any transitory phenomena during rapid deflection of the oxygen jet. A pressure sensor 9 measures the actual pressure P at the entry to blast pipe 11. This pressure P is compared in a comparator means 14 to a reference pressure $P_o$; and in the event of a difference, a regulator 10 acts on the degree of opening of valve 8. Instead of implementing a control loop, it is also possible to determine, by simple testing, the region within which the degree of opening of valve 8 must vary.

In order to achieve the desired effect of variable deflection, it is necessary that the oxygen jet possess a pressure upstream of blast pipe 11 such that the velocity of the gas is sonic when passing a hypothetical plane 12 through the peak of edge 16, and normal to jacket 4 (theoretically, normal to the velocity vector of the gas). It is at the peak of this sharp edge 16 that the jet expands, constituting the origin of a large number of shock waves which are the basis for an increase in velocity of the jet, and of its deflection. The angle of deflection A varies as a function of the pressure of the gas at the location of the edge, i.e., the greater the pressure of the gas, the smaller the angle A. Conversely, the effect of deflection by edge 16 is practically zero when the gas has a subsonic velocity on crossing plane 12. Consequently, by varying the degree of opening of valve 8 between predetermined limits, a solid angle can be swept out, approaching some 40°. To suit the needs of the refining process, it is also possible to adopt a predetermined deflection angle A, and keep said angle constant.

It will be appreciated that to have the desired effect, it is advantageous, but not absolutely necessary, to utilize a convergent section, upstream of plane 12, which accelerates the gas to sonic velocity. It is also preferable, from the standpoint of fluid flow (but again not essential), for duct 5 to open without change in direction into the straight surface of blast pipe 11, upstream of edge 16. It is only necessary to provide, upstream of edge 16, a wall along which the gas can flow in a linear path; and ensure that it possesses a sonic velocity at the location of edge 16. Extending the present invention to its outer limit, it will be appreciated that blast pipes of constant cross section may be supplied at a pressure so that the gas is at a sonic velocity at the approach to orifice 3, with wall 7 defining a simple 90° bend.

Given that the velocity at which the jet leaves orifice 3 is usually sonic or supersonic, there is a latent risk that the jet will just reach the walls of the converter, and not break down the refractory material. It is consequently important to avoid the formation of a "penetrating" jet. This can be achieved by continuously varying the inclination of the jet, since the resulting turbulences in the converter are less favorable for straight-line propagation of the jet; or by choosing a very low orifice height, on the order of one centimeter, since a narrow jet is retarded over a relatively short distance by the surrounding agitated environment. The first solution brings into play substantial oxygen quantities, but excludes operation under a constant inclination.

The present invention has been described by aid of elongated orifices perpendicular to the axis of the nozzle. Alternatively, it will be appreciated that the orifices could be arranged obliquely to the axis (for example, having interactions between the various jets), resulting in localized atmosphere turbulence. It is also possible to provoke a turbulence effect by choosing a curved edge, instead of a straight one. Similarly, edge 16, instead of being arranged so as to cause an upward deflection of the jet, can be arranged, after suitable modification of the oxygen supply ducts 5, to cause a downward deflection of the jet.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A blast pipe for a refining nozzle, the blast pipe being positioned in a gas supply duct and being associated with a pressure regulating valve, the blast pipe terminating at a blast pipe exit orifice, the blast pipe comprising:

a straight wall section, one side of said straight wall section terminating at an edge, said edge defining a portion of the blast pipe exit orifice, wherein gas flows in a linear path along the straight wall section and strikes said edge; and a bent wall segment located adjacent to and downstream of the remainder of said straight wall section, said bent wall segment defining the remainder of said blast pipe exit orifice.

2. The blast pipe according to claim 1 wherein:
said bent wall segment has a divergent configuration.

3. The blast pipe according to claim 1 wherein:
said bent wall segment has a convergent configuration upstream of said edge and a divergent configuration downstream of said edge.

4. The blast pipe according to claim 3 wherein:
said bent wall segment forms a throat upstream of said edge.

5. The blast pipe according to claim 1 wherein:
said edge defines a straight line.

6. The blast pipe according to claim 2 wherein:
said edge defines a straight line.

7. The blast pipe according to claim 3 wherein:
said edge defines a straight line.

8. The blast pipe according to claim 4 wherein:
said edge defines a straight line.

9. The blast pipe according to claim 5 wherein:
said orifice has a rectangular cross section, one of the long sides of said rectangular cross section comprising said edge.

10. The blast pipe according to claim 9 wherein:
said rectangular orifice has a height of about one centimeter.

11. The blast pipe according to claim 5 wherein:
a plane passing through said edge is normal to the axis of said nozzle.

12. The blast pipe according to claim 1 wherein:
said straight wall section has a substantially cylindrical configuration.

13. The blast pipe according to claim 5 wherein:
said edge is a sharp edge.

* * * * *